US009638458B2

(12) United States Patent
Choo et al.

(10) Patent No.: US 9,638,458 B2
(45) Date of Patent: May 2, 2017

(54) REFRIGERATOR

(71) Applicant: LG ELECTRONICS INC., Seoul (KR)

(72) Inventors: Ayoung Choo, Seoul (KR); Jaeyoul Lee, Seoul (KR); Taegyeong Kim, Seoul (KR); Myeongha Yi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/631,505

(22) Filed: Feb. 25, 2015

(65) Prior Publication Data

US 2015/0276304 A1 Oct. 1, 2015

(30) Foreign Application Priority Data

Mar. 28, 2014 (KR) ..... 10-2014-0036537

(51) Int. Cl.
*F25D 25/02* (2006.01)
*F25D 25/04* (2006.01)
*A47B 57/08* (2006.01)

(52) U.S. Cl.
CPC ..... *F25D 25/024* (2013.01); *F25D 25/02* (2013.01); *A47B 57/08* (2013.01); *F25D 25/04* (2013.01)

(58) Field of Classification Search
CPC ..... F25D 25/00; F25D 25/02; F25D 25/021; F25D 25/024; F25D 25/025; F25D 25/027; F25D 25/04; F25D 23/067; A47B 57/06; A47B 57/08; A47B 57/10; A47B 57/20; A47B 57/22; A47B 57/26; A47B 57/265; A47B 57/30; A47B 57/32; A47B 57/34; A47B 57/48; A47B 57/482; A47B 57/485;

(Continued)

(56) References Cited

U.S. PATENT DOCUMENTS 1,257,998 A * 3/1918 A. B. Gruber ..... 292/170
2,739,864 A * 3/1956 Saunders ..... 312/306

(Continued)

FOREIGN PATENT DOCUMENTS

DE 10 2010 030 580 A1 12/2011
DE 10 2011 075 102 A1 11/2012

(Continued)

OTHER PUBLICATIONS

European Search Report dated Oct. 2, 2015 issued in Application No. 15158851.4.

*Primary Examiner* — Andrew Roersma
(74) *Attorney, Agent, or Firm* — KED & Associates, LLP

(57) ABSTRACT

A refrigerator may include a cabinet defined with a storage chamber therein, and a shelf assembly mounted in the storage chamber provided with a vertically movable shelf. The shelf assembly includes a guide member mounted in the storage chamber while having guide slots inclinedly formed at side walls of the guide member. The shelf is supported by the guide member to be vertically movable. Guide protrusions are provided at opposite lateral ends of the shelf to protrude laterally and are supported by the guide slots in a state of being slidably engaged in the guide slots. The guide slots have bent upper ends forming upper seats to support the guide protrusions. Each upper seat is formed such that a straight vertical line extending downwards from a center of the upper seat passes through a center of a lower seat formed at the corresponding guide slot.

20 Claims, 7 Drawing Sheets

(58) Field of Classification Search
CPC ..... A47B 57/487; A47B 57/54; A47B 57/545; A47B 57/12; A47B 57/14; A47B 57/36; A47B 57/38
See application file for complete search history.

(56) References Cited

U.S. PATENT DOCUMENTS

| | | | | | |
|---|---|---|---|---|---|
| 3,113,818 | A * | 12/1963 | Armentrout et al. | ..... | 312/298 |
| 3,292,986 | A * | 12/1966 | Fenwick | ..... | 312/333 |
| 3,516,369 | A * | 6/1970 | Bidak et al. | ..... | 108/138 |
| 3,859,932 | A * | 1/1975 | Armstrong et al. | ..... | 108/75 |
| 8,052,236 | B2 * | 11/2011 | Kim | ..... | 312/405.1 |
| 8,333,446 | B2 * | 12/2012 | Kang | ..... | 312/404 |
| 8,376,482 | B2 * | 2/2013 | An et al. | ..... | 312/408 |
| 2006/0103272 | A1 * | 5/2006 | Chen et al. | ..... | 312/223.2 |
| 2006/0254996 | A1 * | 11/2006 | McAfee | ..... | A47B 57/10 211/90.02 |
| 2007/0035220 | A1 * | 2/2007 | Bond et al. | ..... | 312/319.1 |
| 2007/0096610 | A1 * | 5/2007 | Filho et al. | ..... | 312/408 |
| 2012/0091084 | A1 * | 4/2012 | Amaral et al. | ..... | 211/80 |
| 2013/0106274 | A1 * | 5/2013 | Yang | ..... | 312/404 |

FOREIGN PATENT DOCUMENTS

| | | | | | |
|---|---|---|---|---|---|
| EP | 1956324 | A2 * | 8/2008 | ..... | F25D 25/02 |
| EP | 2250928 | A1 * | 11/2010 | ..... | A47B 57/10 |
| EP | 2392878 | A2 * | 12/2011 | ..... | F25D 25/02 |
| JP | H 09250870 | A * | 9/1997 | ..... | F25D 25/02 |
| JP | 2003269857 | A * | 9/2003 | ..... | F25D 25/02 |
| JP | 2003294357 | A * | 10/2003 | ..... | F25D 25/02 |
| KR | 20-0110439 | Y1 | 3/1994 | | |
| KR | 20-1995-0002348 | Y1 | 3/1995 | | |
| KR | 10-1997-0011754 | A | 3/1997 | | |
| KR | 1020060030563 | A * | 4/2006 | ..... | F25D 25/02 |
| KR | 10-2006-0040290 | A | 5/2006 | | |
| WO | WO 03095912 | A1 * | 11/2003 | ..... | F25D 25/02 |
| WO | WO 2011160699 | A1 * | 12/2011 | ..... | F14D 23/06 |
| WO | WO 2012062675 | A2 * | 5/2012 | ..... | F25D 25/02 |

* cited by examiner

REFRIGERATOR

CROSS-REFERENCE TO RELATED APPLICATION

This application claims priority under 35 U.S.C. §119 to Korean Application No. 10-2014-0036537 filed on Mar. 28, 2014, whose entire disclosure is incorporated herein by reference.

BACKGROUND

1. Field

The present disclosure relates to a refrigerator.

2. Background

Generally, a refrigerator is an appliance for storing food, etc. within a storage chamber in a frozen or refrigerated state by discharging, into the storage chamber, cold air generated through a refrigeration cycle constituted by a compressor, a condenser, an expansion valve, an evaporator, etc. Such a refrigerator generally includes a freezing compartment for storing food or beverages in a frozen state, and a refrigerating compartment for storing food or beverages at low temperature. A Kimchi refrigerator, which stores food such as Kimchi or vegetables in a fresh state, is another form of refrigerator.

At least one of plural doors installed at a refrigerator is connected to one side of a body by a hinge, to open or close a front side of the body through pivotal movement thereof. In addition to such a door, which pivots about a hinge, a drawer type door may also be employed. The drawer type door includes a drawer, and a door mounted to a front side of the drawer, to be withdrawn or retracted in a forward or rearward direction, together with the drawer.

Generally, storage compartments of a refrigerator, namely, freezing and refrigerating compartments, are provided with a plurality of shelves to vertically divide the freezing and refrigerating compartments into sections, in order to store food articles having various sizes and to enhance space utilization. Since food articles to be placed on such shelves may have various sizes, the shelves are separably mounted at different levels in the freezing and refrigerating compartments while being movable to adjust mounting levels thereof.

Mounting of the shelves may be achieved by slidably mounting the shelves to a plurality of support ribs formed at left and right surfaces of the refrigerating and freezing compartments, or coupling a pair of cantilevers coupled to each shelf, and then mounting the cantilevers to mounting rails each formed with a plurality of vertically arranged holes.

Level adjustment of shelves may be difficult and troublesome because, when it is desired to adjust mounting level of a shelf, the user has to separate the shelf from the support ribs or mounting rails after completely removing food articles from the shelf, and then to mount the separated shelf to another level.

In this regard, the applicant proposed a structure capable of adjusting the level of a shelf while food is placed thereon, as disclosed in Korean Unexamined Patent Publication No. 10-2006-0040290. However, the disclosed structure has a problem in that, when it is desired to adjust the level of a shelf, the user has to move the shelf along an inclined guide slot in forward and rearward directions by a long distance. Furthermore, the shelf should be moved between an initial position and a final position by a considerable distance.

There also may be a danger in that, when the shelf is used under a condition that the shelf is disposed at an upper position thereof, and food articles are placed on the shelf, the shelf may be moved to a lower position thereof along the guide slot.

The above references are incorporated by reference herein where appropriate for appropriate teaching of additional or alternative detail s, features and/or technical background

BRIEF DESCRIPTION OF THE DRAWINGS

The embodiments will be described in detail with reference to the following drawings in which like reference numerals refer to like elements wherein.

DETAILED DESCRIPTION

Figure 1:
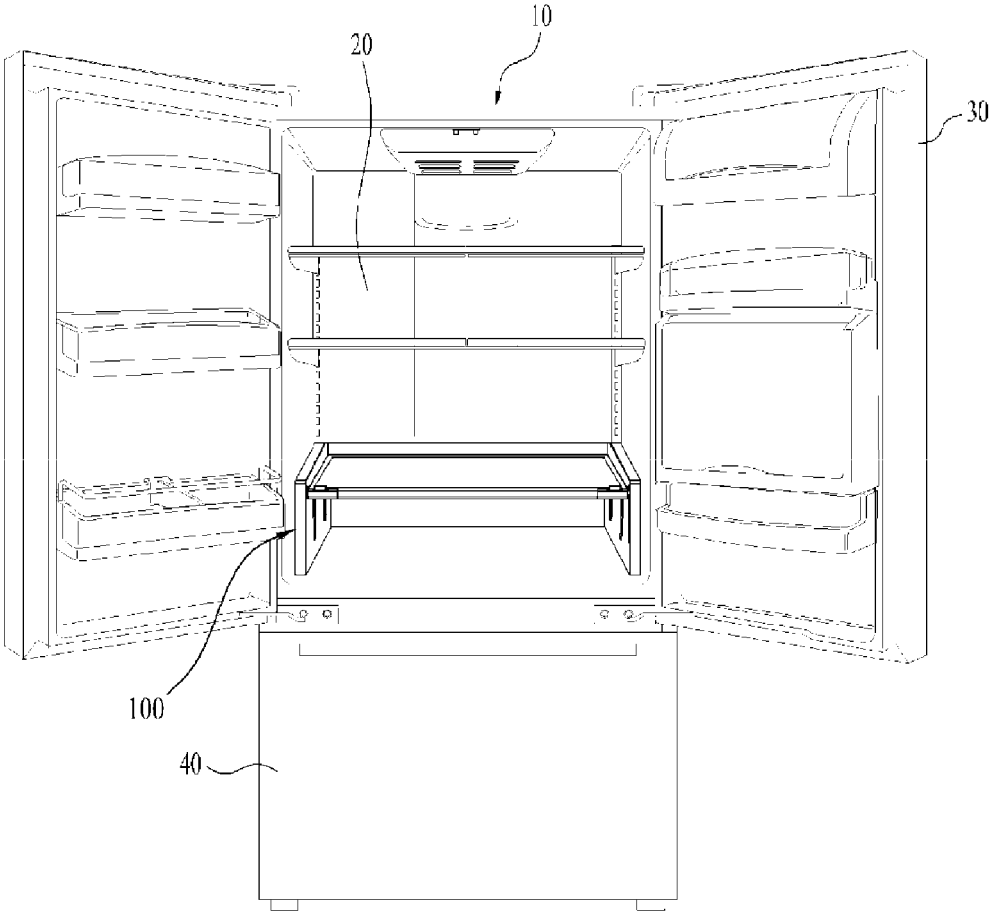
FIG. 1 is a perspective view illustrating a bottom freezer type refrigerator equipped with a shelf assembly in accordance with the present disclosure.

FIG. 1 is a perspective view illustrating a bottom freezer type refrigerator equipped with a shelf assembly in accordance with the present disclosure. The refrigerator includes a cabinet 10 defined with a storage chamber therein, and a shelf assembly 100 mounted in the storage chamber, to be vertically movable.

The illustrated refrigerator is a bottom freezer type refrigerator in which a refrigerating compartment 20 is provided at a top side of the cabinet 10, and a freezing compartment is provided at a bottom side of the cabinet 10. However, the present disclosure may also be applied to refrigerators of other types, so long as the shelf assembly 100 is mountable in a storage chamber such as a refrigerating compartment or a freezing compartment.

Refrigerators of other types include a side-by-side type refrigerator in which a freezing compartment and a refrigerating compartment are laterally arranged, and a top mounting type refrigerator in which a freezing compartment is arranged over a refrigerating compartment. The present disclosure may be applied to a refrigerator including a refrigerating compartment or a freezing compartment alone, so long as the shelf assembly 100 is mountable in the storage chamber.

The shelf assembly 100 may mainly be mounted in a refrigerating compartment, but may be mounted to a freezing compartment. The refrigerating compartment 20 provided at the top side of the cabinet 10 may be opened or closed by a pair of pivotally-mounted refrigerating compartment doors 30. The freezing compartment provided at the bottom side of the cabinet 10 may be opened or closed by a freezing compartment door 40, which is a drawer type door. Of course, the freezing compartment door 40 may be a pivotally-mounted door, in place of the drawer type door.

The shelf assembly 100 may mainly be mounted in a lower portion of the refrigerating compartment 20, and may include a vertically movable shelf. The shelf assembly 100 may further include at least one shelf separably mounted on the shelf assembly 100. As illustrated in FIG. 1, the shelf mounted on the shelf assembly 100 may be supported by cantilevers. This shelf may be also supported by shelf support ribs.

Figure 2:
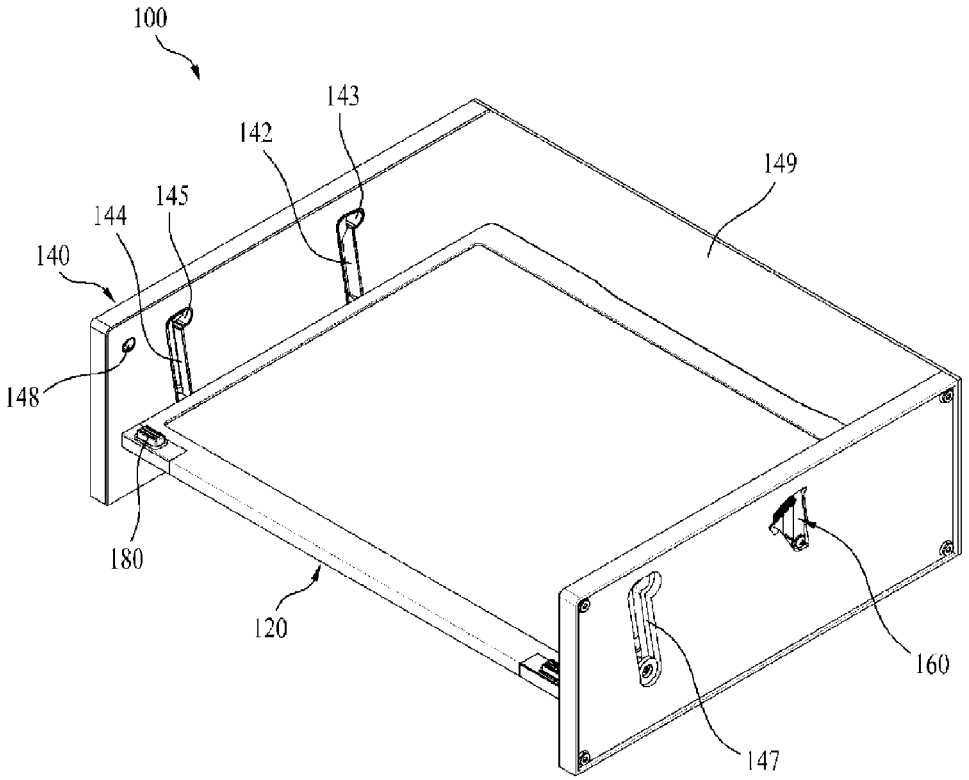
FIG. 2 is a perspective view illustrating a shelf assembly according to a preferred embodiment of the present disclosure.
Figure 3:
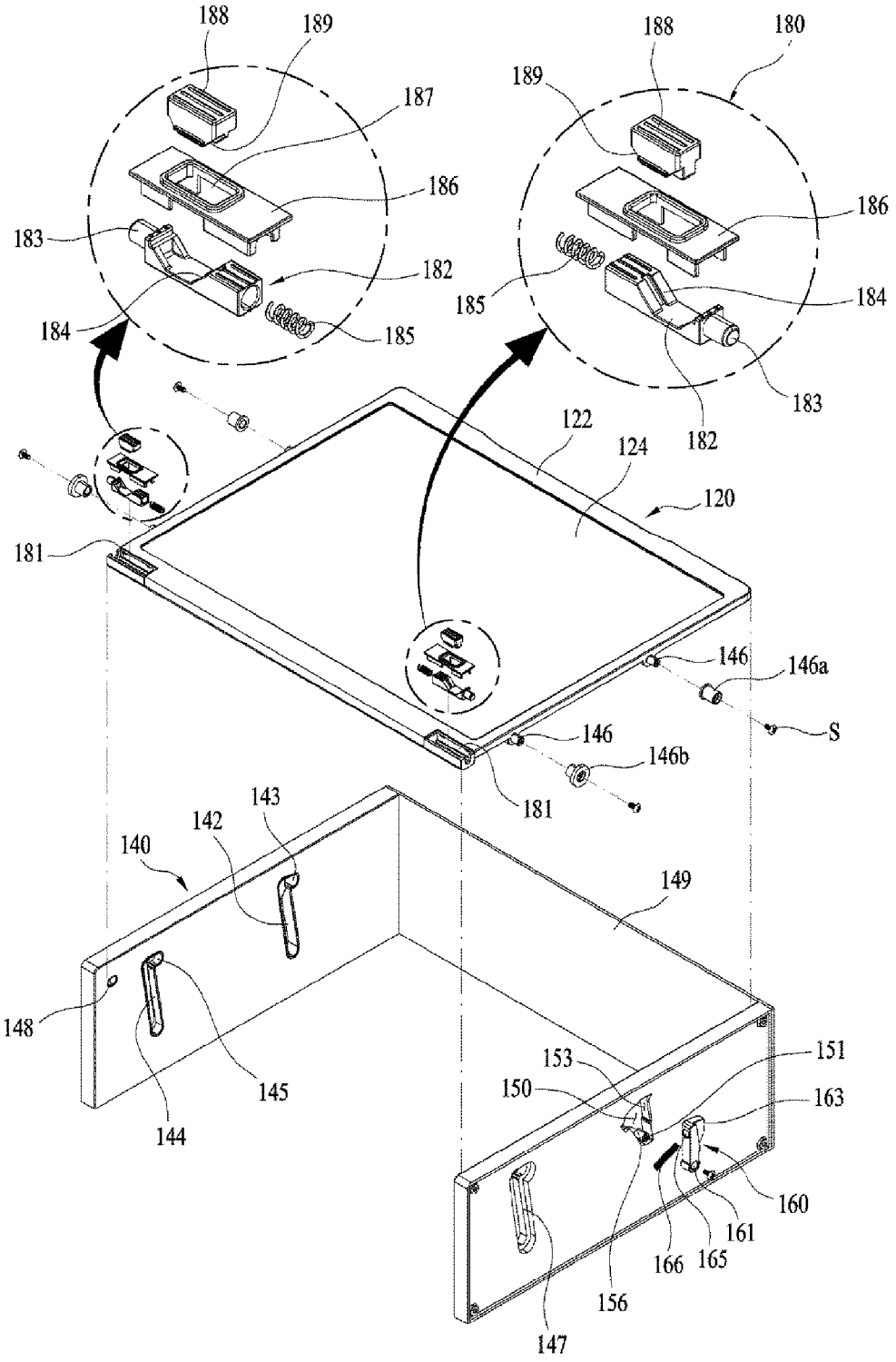
FIG. 3 is an exploded perspective view illustrating an exploded state of the shelf assembly illustrated in FIG. 2.

FIG. 2 is a perspective view illustrating a shelf assembly according to a preferred embodiment of the present disclosure. FIG. 3 is an exploded perspective view illustrating an exploded state of the shelf assembly illustrated in FIG. 2.

The shelf assembly 100 according to the illustrated embodiment of the present disclosure may include a guide member 140 mounted in the storage chamber, and provided with guide slots 142 and 144 inclinedly formed at side walls of the guide member 140. The shelf assembly 100 also includes a shelf 120 supported by the guide member 140, to be vertically movable, and guide protrusions 146 provided at opposite lateral ends of the shelf 120, to protrude laterally, and supported by the guide slots 142 and 144 in a state of being slidably engaged in the guide slots 142 and 144.

The guide member 140 may have a plate shape having a predetermined thickness. The guide slots 142 and 144 may be formed at an inner surface of the guide member 140 while having a depth smaller than the thickness of the guide member 140. The guide member 140 may be mounted to an inner side surface of the refrigerating compartment 20 by fasteners such as screws.

The guide member 140 may include a pair of side walls each formed with the guide slots 142 and 144, and to guide vertical movement of the shelf 120 while supporting the shelf 120, and a rear wall 149 connecting rear ends of the side walls. The guide member 140 may have a more firm structure, may maintain a desired spacing between the side walls thereof, and may be mounted to be seated on the bottom of the refrigerating compartment 20.

In accordance with the above-described structure of the guide member 140, it may be possible to easily mount the shelf assembly 100 in the refrigerating compartment 20 in a state of being assembled into a single set.

Of course, the guide member 140 may be fastened to the inner surface of the refrigerating compartment 20, to be fixed to the refrigerating compartment 20, in order to prevent the guide member 140 from being moved when the user lifts the shelf 120.

In the case in which the guide member 140 is mounted to the inner side walls of the refrigerating compartment 20 by fasteners, the guide member 140 may only include a pair of side walls while eliminating connection by the rear wall 149. The width of the shelf 120 may be determined, taking into consideration the spacing between the side walls of the refrigerating compartment 20 and the thickness of the guide member 140.

The guide slots 142 and 144 may include a pair of guide slots provided at each of the side walls of the guide member 140 while being spaced from each other in forward and rearward directions by a predetermined distance. Two guide slots 142 and 144 are formed at the left wall of the guide member 140, and two guide slots 142 and 144 are formed at the right wall of the guide member 140.

The guide slots 142 and 144 may include a pair of first guide slots 142 each formed at an inner surface of a rear portion of the corresponding side wall in the guide member 140 while taking the form of a groove having a predetermined depth, and a pair of second guide slots 144 each formed at a front portion of the corresponding side wall in the guide member 140 while taking the form of a through hole extending through the side wall.

The shelf 120 is supported by the guide member 140, to be vertically movable. The guide protrusions 146 are provided at the opposite lateral ends of the shelf 120, to protrude laterally, and are supported by the guide slots 142 and 144 in a state of being slidably engaged in the guide slots 142 and 144. In the illustrated embodiment, a total of four guide protrusions 146 may be formed at positions corresponding to the four guide slots 142 and 144, to be engaged in the four guide slots 142 and 144, respectively.

The guide protrusions 146 may include a pair of first guide protrusions 146 to be guided by the first guide slots 142 while being engaged therein, respectively, and a pair of second guide protrusions 146 to be guided by the second guide slots 144 while being engaged therein, respectively.

Figure 4:
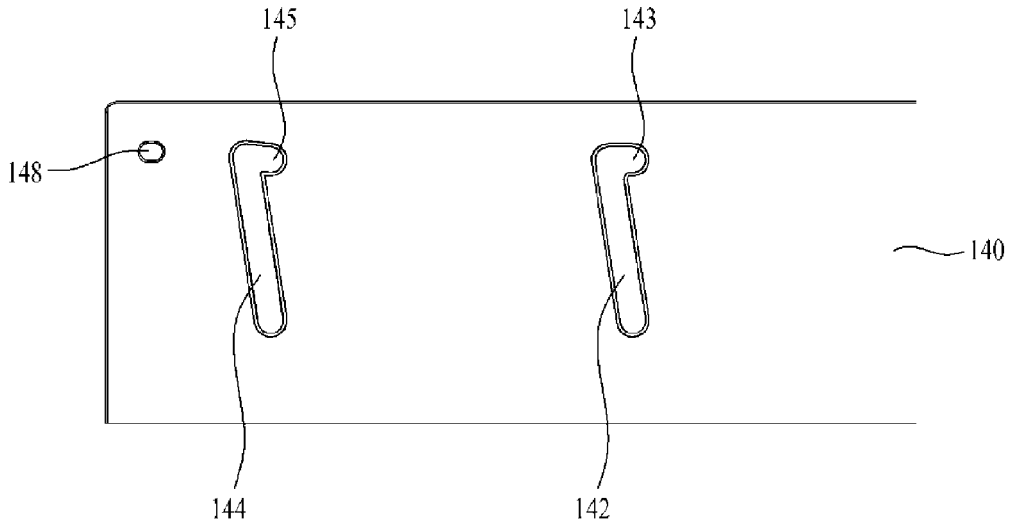
FIG. 4 is a right side view illustrating a left shelf guide illustrated in FIG. 2.

As illustrated in FIG. 4, the guide slots 142 and 144 may have bent upper ends forming upper seats 143 and 145 to support the guide protrusions 146, respectively. Each of the upper seats 143 and 145 is formed such that a straight vertical line extending downwards from the center of the upper seat 143 or 145 passes through the center of a lower seat formed at the corresponding guide slot 142 or 144.

Each of the upper seats 143 and 145 and the corresponding lower seat in the guide slots 142 and 144 have the same position in forward and rearward directions and as such, the shelf 120 may have the same horizontal position before and after movement thereof.

The shelf 120 has the same horizontal position in raised and lowered states, except that the shelf 120 has different levels at the raised and lowered positions, and, as such, it may be possible to achieve efficient space utilization in that no dead space is generated due to movement of the shelf.

The guide slots 142 and 144 are inclined forwards by a predetermined angle with respect to a vertical line perpendicular to the bottom surface of the refrigerating compartment. The inclination angle may be 20° or less with respect to the vertical line. As the inclination angle increases, the movement distance of the shelf 120 in forward and rearward directions upon movement of the shelf 120 is increased and, as such, limitation of the length of the shelf 120 in forward and rearward directions is increased.

When the shelf 120 is lifted, the guide protrusions 146 are moved along the inclined guide slots 142 and 144, thereby causing the shelf 120 to move forwards by a predetermined distance and, as such, it may be desirable that the front surface of the shelf 120 not protrude further forward than the front surface of the guide member 140. The inclination angle of the guide slots 142 and 144 with respect to a vertical line is minimized, so long as the guide protrusions 146 can be stably seated in the guide slots 142 and 144.

The upper ends of the guide slots 142 and 144 are bent rearwards, to extend to the upper seats 143 and 145. The upper seats 143 and 145 have a bottom surface formed to extend horizontally or to be inclined rearwards and downwards. As illustrated in FIG. 4, the upper seat 143 of each first guide slot 142 may be formed to extend horizontally, whereas the upper seat 145 of each guide slot 144 may be formed to be inclined rearwards and downwards from a bent portion of the upper end of the second guide slot 144.

Each guide protrusion 146 has a circular cross-section and, as such, the end portions of the upper and lower seats in each guide slot may have a semi-circular shape. Each second guide slot 144 may be formed such that the bent portion thereof disposed adjacent to the upper seat 145 has a level higher than a lower end of the upper seat 145. The guide protrusion 146, which has been supported by the upper seat 145 of each second guide slot 144 is prevented from being easily separated from the upper seat 145. It may be possible to prevent the shelf 120 from being unintentionally moved downwards even when the user touches the shelf 120 or impact is applied to the refrigerator in a state in which the shelf 120 is positioned at a raised position thereof.

The upper seat 143 of each first guide slot 142 is formed not to be inclined. This is because operation of the user to lower the shelf 120 from a raised position of the shelf 120 may be difficult when the upper seat 143 is inclinedly formed, and the guide protrusion 146 may be easily moved to the upper seat 143 when the upper seat 143 is formed to extend horizontally.

The reason why a selected one of the two guide slots, namely, the second guide slot 144, is inclinedly formed is to achieve convenience of user's operation because the user lowers the shelf 120 from the raised position while slightly lifting the shelf 120 under the condition that the user grasps a front lower surface of the shelf 120.

Meanwhile, as illustrated in FIG. 3, rollers 146*a* and 146*b* may be mounted to the first and second guide protrusions 146, respectively. The rollers 146*a* and 146*b*, namely, the first roller 146*a* to be engaged in the corresponding first guide slot 142 and the second roller 146*b* to be engaged in the corresponding second guide slot 144, are identical in that they are fastened by screws S, even though they have slightly different shapes.

When the rollers 146*a* and 146*b* are mounted to the first and second guide protrusions 146, respectively, more smooth movement of the first and second guide protrusions 146 may be achieved as the rollers 146*a* and 146*b* roll in the guide slots 142 and 144 while rotating. Since each first guide slot 142 takes the form of a groove having a certain depth without extending through the inner surface of the guide member 140, each first roller 146*a* is formed to have a slightly smaller diameter than the width of each first guide slot 142. Each second guide slot 144 is formed to extend through the guide member 140 and, as such, each second roller 146*b* may be mounted in the corresponding second guide slot 144 while extending through the second guide slot 144.

A step 147 is provided at an outer portion of each guide slot 144, to increase the width of the guide slot 144. The second roller 146*b*, which is engaged in the guide slot 144, has a stepped structure, to be supported by the step 147 while contacting the step 147 after passing through the second guide slot 144.

As compared to mounting each second roller 146*b* to protrude from the outer surface of the corresponding through hole-shaped second guide slot 144 after completely extending the second guide slot 144, the second roller 146*b* is mounted without protruding from the outer surface of the second guide slot 144, to allow the guide member 140 to closely contact the side surfaces of the refrigerating compartment 20.

Accordingly, it may be possible to prevent the second roller 146*b* from protruding from the outer surface of the guide member 140 by forming the step 147 at the second guide slot 144, and forming the second roller 146*b* movably supported by the second guide slot 144 and step 147 to be stepped corresponding to the second guide slot 144.

In addition, since the stepped second rollers 146*b* are provided at each pair of second guide protrusions 146, and are supported by the steps 147 of each pair of the second guide slots 144, it may be possible to prevent the shelf 20 from being inclined in a left or right direction during movement thereof.

If the shelf 20 is inclined during movement thereof between raised and lowered positions, articles placed thereon may fall. In the illustrated embodiment, however, the shelf 20 may be maintained in a horizontal state during movement thereof because the stepped surfaces of the second rollers 146*b* are supported by the surfaces of the steps 147, respectively.

The shelf 120 may include a peripheral portion 122 to be movable between raised and lowered positions while being guided by the guide member 140, and a shelf portion 124 mounted to the peripheral portion 122 inside the peripheral portion 122 and made of a transparent material. When the shelf 120 is positioned at a raised position, food articles may be placed beneath the shelf 120 and, as such, the user may identify the food articles through the transparent shelf portion 124. The peripheral portion 122 may mainly be made of a plastic material, to achieve easy molding thereof. The shelf portion 124 may be made of a transparent plastic material or a reinforced glass material.

The guide protrusions 146 may be formed at the peripheral portion 122, to be integrated with the peripheral portion 122. Button mounting grooves 181 for button assemblies 180, which will be described later, may also be provided at the peripheral portion 122.

The shelf assembly 100 may further include a pair of lever assemblies pivotally mounted to respective side walls of the guide member 140, to push the first guide protrusions 146 in a rearward direction when the first guide protrusions 146 move to the upper seats 143 of the first guide slots 142, respectively. Each lever assembly may be pivotally mounted at a position adjacent to the corresponding first guide slot 142, and elastically pushes the corresponding first guide protrusion 146 in a rearward direction when the first guide protrusion 146 approaches the upper seat 143 of the first guide slot 142 or is seated in the upper seat 143.

The upper seat 143 of each first guide slot 142 is horizontally formed. Once the corresponding first guide protrusion 146 moves to the bent portion of the first guide slot 142, the first guide protrusion 146 may be smoothly seated in the upper seat 143 while being pushed by the corresponding lever assembly.

Each of the lever assemblies may include a lever guide groove 150 formed at the corresponding side wall of the guide member 140 while having a concave shape, a pivotal pin 151 protruding from the lever guide groove 150, a lever member 160 pivotally mounted to the pivotal pin 151 in the lever guide groove 150, and an elastic member 166 disposed between one side surface of the lever guide groove 150 and the lever member 160, to push the lever member 160 in a rearward direction.

The lever guide groove 150 may be formed at a position adjacent to a front side of the guide groove 142 on the outer surface of the corresponding side wall of the guide member 140 while having a concave shape. The lever guide groove 150 functions to guide pivotal movement of the lever member 160 while supporting the lever member 160. Accordingly, the lever guide groove 150 may generally take the form of an arc extending through a predetermined angle.

The pivotal pin 151 protrudes from a lower portion of the lever guide groove 150. The lever member 160 is formed, at a lower end thereof, with a pivotal pin hole 161 and, as such, may be pivotably mounted to the pivotal pin 151. The lever member 160 may be mounted to the pivotal pin 151 by a fastener such as a screw. In this case, the pivotal pin 151 may take the form of a boss formed with a screw hole.

The elastic member 166 is disposed between one side surface of the lever guide groove 150 and the lever member 160, to supply elastic force for urging the lever member 160 toward the upper seat 143. An elastic member support groove 156 is provided at one side surface of the lever guide groove 150, and an elastic member receiving groove 165 is provided at one side of the lever member 160, for mounting of the elastic member 166.

The elastic member support groove 156 and elastic member receiving groove 165 function to support the elastic member 166 in order to prevent the elastic member 166 from being separated from a mounted position thereof even when compressed or extended. One of the grooves 156 and 165 may take the form of a protrusion, or each of the grooves 156 and 165 may take the form of a protrusion. The elastic member 166 is illustrated as being a coil spring. However, a torsion spring or a spring of another form may be used, so long as it supplies elastic force capable of pivoting the lever member 160 in one direction.

A through hole 153 to be connected to the first guide slot 142 may be formed at an upper portion of a rear side wall of the lever guide groove 150. A push portion 163 formed at an upper rear portion of the lever member 160 may push the first guide protrusion 146 while selectively passing through the through hole 153.

Figure 5A:
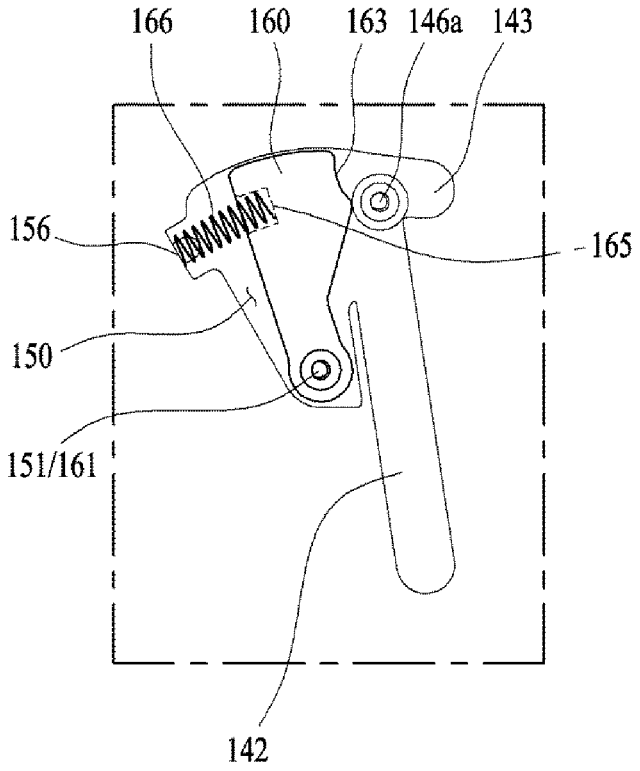
FIGS. 5A to 5C are right side views illustrating operations of a guide protrusion and a lever assembly provided at the shelf.
Figure 5B:
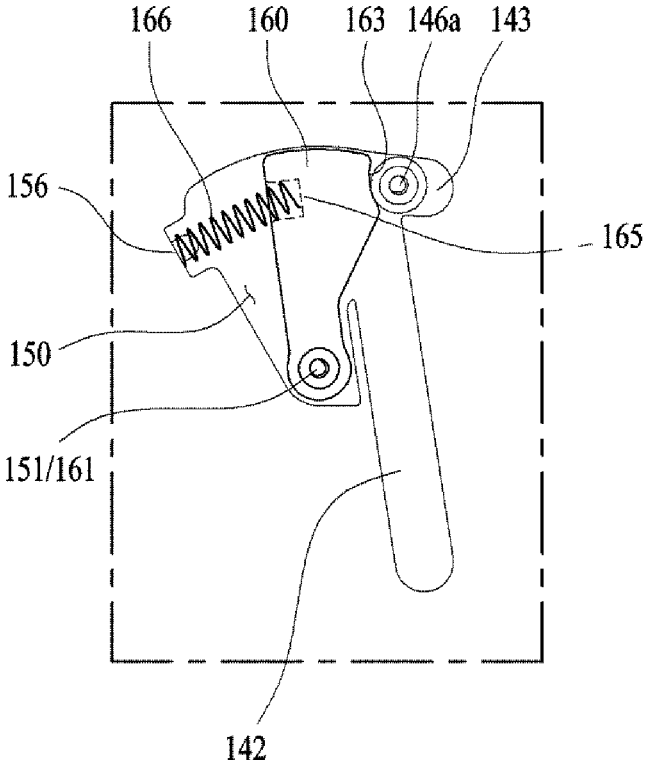

Operations of each guide protrusion and each lever assembly will be described with reference to FIGS. 5A to 5C. As illustrated in FIG. 5A, the user lifts the shelf 120, thereby causing the first guide protrusions 146 or first rollers 146*a* to move upwards along the first guide slots 142, respectively.

Each lever member 160 is pushed by the corresponding first roller 146*a*, thereby causing the corresponding elastic member 166 to be compressed, and elastic energy is accumulated in the compressed elastic member 166. When the first roller 146*a* moves to an uppermost position thereof, as illustrated in FIG. 5B, the corresponding lever member 160 pushes the first roller 146*a* into the corresponding upper seat 143 by compressive force of the compressed elastic member 166.

Figure 5C:
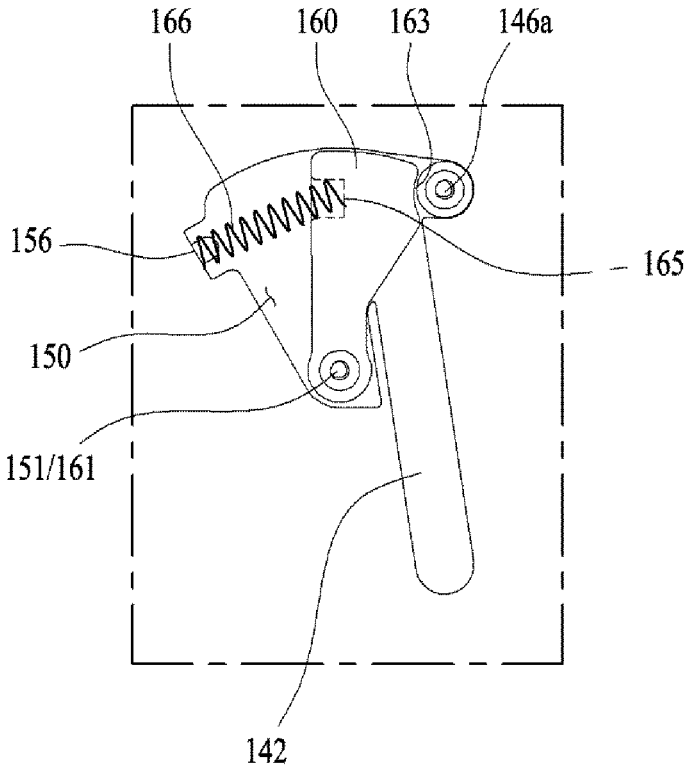

The first roller 146*a* is seated in and supported by the upper seat 143, as illustrated in FIG. 5C. Although the bottom surface of the upper seat 143 is horizontal, the first roller 146*a* is prevented from being easily separated from the upper seat 143 because the lever member 160 continuously elastically pushes the first roller 146*a*.

As illustrated in FIG. 3, the shelf assembly 100 may further include a pair of button assemblies 180 provided at opposite sides of a front portion of the shelf 120 and configured to retract locking protrusions 183 thereof from a state of extending outwards from respective lateral sides of the shelf 120 when the button assemblies 180 operate. Locking grooves 148 are formed at respective side walls of the guide member 140 to selectively receive respective locking protrusions 183.

Since the button assemblies 180 are arranged at opposite sides of the front portion of the shelf 120, the user may easily lower the shelf 120 from a raised position to a lowered position while depressing buttons of the button assemblies 1280 by both hands. When the user simultaneously operates the button assemblies 180, the locking protrusions 183, which have been extended outwards from respective lateral sides of the shelf 120, are retracted from respective lateral sides of the shelf 120.

A pair of locking grooves 148 is formed at positions corresponding to respective locking protrusions 183 on respective inner surfaces of the side walls of the guide member 140, as described above. The positions corresponding to respective locking protrusions 183 mean positions at which the locking protrusions 183 are insertable into the locking grooves 148, respectively, when the shelf 120 is positioned at a raised position.

Upon lowering the shelf 120 from a raised position, the user should release a locked state of the shelf 120 by pressing the buttons of the button assemblies 180. In this state, the user may lower the shelf 120 to a lowered position after pulling the shelf 120 forwards. The button assemblies 180 are safety devices for preventing the shelf 120 from unintentionally falling from a raised position, together with the inclined upper seats 145 and lever assemblies.

As illustrated in FIG. 3, each of the button assemblies 180 may include one button mounting groove 181 provided at a corresponding one of the opposite sides of the front portion of the shelf 120, a slider 182 slidably mounted in the button mounting groove 181 and formed, at one end thereof, with the corresponding locking protrusion 183, a button 188 to laterally move the slider 182 when pressed by the user, and an elastic member 185 disposed between the slider 182 and one side surface of the button mounting groove 181, to push the slider 182 outwards.

The button mounting groove 181 may be formed at the peripheral portion 122 of the shelf 120, to be integrated therewith. Alternatively, the button mounting groove 181 may take the form of a separate member, to be coupled to the peripheral portion 122. A hole is formed through one side surface of the button mounting groove 181, to allow the locking protrusion 183 to pass therethrough.

The slider 182, which is formed, at one end thereof, with the corresponding locking protrusion 183, to be integrated therewith, is mounted in the button mounting groove 181, to be laterally slidable. The elastic member 185 is mounted between the slider 182 and one side surface of the button mounting groove 181, to supply elastic force urging the slider 182 toward the locking protrusion 183.

As illustrated in FIG. 3, a groove may be formed at one side surface of the slider 182, to receive one end of the elastic member 185. Alternatively, a protrusion may be formed in place of the groove. The button 188 laterally moves the slider 182 when pressed by the user.

In order to retract the locking protrusion 183, the slider should be moved in a left or right direction. To this end, the slider 182 may be provided with a handle portion protruding above an upper surface of the shelf 120 while taking the form of a protrusion. When it is desired to lower the shelf 120, the user should release the locked state of the shelf 120 by pushing the handle portions of the sliders 182 in the button assemblies 180 in left and right directions, and should then lower the shelf 120 while maintaining the released state of the shelf 120. However, operation of lowering the shelf 120 while pushing the handle portions in left and right directions and supporting a lower surface of the shelf 120 by both hands may be difficult.

In accordance with the illustrated embodiment of the present disclosure, the user may lower the shelf 120 downwards while pressing the buttons 188 downwards and, as such, operation of the user to lower the shelf 120 may be more easily carried out. It may be needed to configure the sliders 182 to move in corresponding lateral directions, respectively, when the buttons 188 are pressed downwards. In order to guide vertical movement of each button 188, the corresponding button assembly 180 may further include a cover member 186 covering the corresponding button mounting groove 181 while being provided with a guide groove 187 to guide movement of the button 188.

The guide groove 187 is formed at a central portion of the cover member 186 while taking the form of a through hole and, as such, guides vertical movement of the button 188, which is slidably fitted in the guide groove 187. The button 188 may generally have a rectangular parallelepiped shape. Accordingly, the guide groove 187 may also be formed in a rectangular shape.

The cover member 186 may be formed, at a lower surface thereof, with coupling ribs to be engaged with an inner surface of the corresponding button mounting groove 181, in order to be coupled with the button mounting groove 181. As illustrated in an enlarged view of FIG. 3, a stopper protrusion may be formed at a lower end of each button 188 in order to prevent the button 188 from being easily separated in an upward direction after being mounted in the guide groove 187 of the corresponding cover member 186.

A receiving groove may be provided at an upper surface of each slider 182, to receive a lower portion of the corresponding button 188 when the button 188 is pressed. Each button 188 may be also provided with an inclined surface 189 at a lower portion of one side thereof. Corresponding to the inclined surface 189 of the button 188, the receiving groove of the corresponding slider 182 includes an inclined surface 184 formed at one side of the receiving groove, to slide while contacting the inclined surface 189. In accordance with contact-sliding movements of the inclined surface 189 of the button 188 and the inclined surface 184 of the slider 182, downward movement of the button 188 may be converted into lateral movement of the slider 182.

Hereinafter, operation of each button assembly will be described with reference to FIGS. 6A and 6B. The following description will be given only in conjunction with one button assembly, for convenience of description.

Figure 6A:
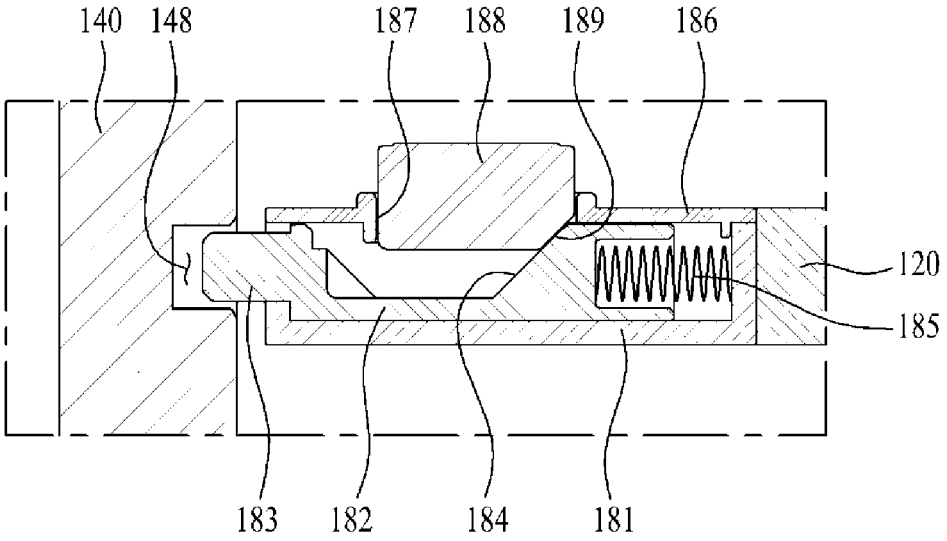
FIGS. 6A and 6B are sectional views illustrating operation of a button assembly.

In a normal state, the locking protrusion 183 has been extended into the locking groove 148 by the elastic member 185, to be engaged in the locking groove 148, as illustrated in FIG. 6A. In this state, the inclined surface 189 of the button 188 has been raised upwards by the inclined surface 184 of the slider 182.

Figure 6B:
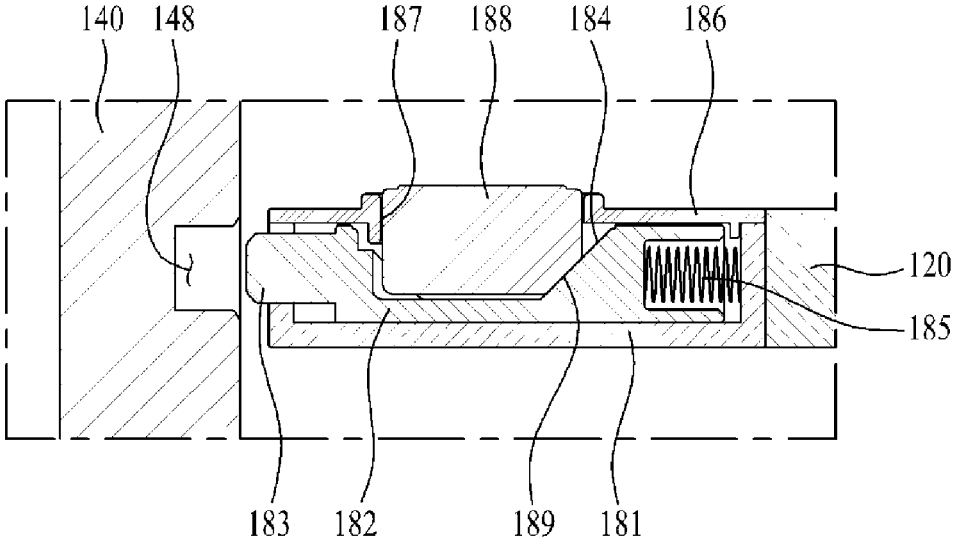

When the user presses the button 188, as illustrated in FIG. 6B, the inclined surface 189 is moved downwards along the inclined surface 184 of the slider 182, thereby laterally pushing the slider 182 against elastic force of the elastic member 185. Then, the user may pull the shelf 120 downwards in a state of pressing the button 188.

When the user releases pressing force applied to the button 188 under the condition that the locking protrusion 183 has been moved together with the shelf 120 after being separated from the locking groove 148, the slider 182 is pushed by the elastic member 185, thereby causing the locking protrusion 183 to extend again. In this state, although the locking protrusion 183 is at an extended position, the user may freely raise or lower the shelf 120 because the locking protrusion 183 is slidable along the inner surface of the guide member 140, so long as the locking protrusion 183 is again engaged in the locking groove 148.

As apparent from the above description, the refrigerator, which includes the shelf assembly according to the present disclosure, may not only achieve easy manufacture thereof and easy operation for vertical movement of the shelf, but also prevent the shelf from falling from a raised position due to carelessness or impact, because the structure of the shelf assembly is simple.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

The present disclosure provides a refrigerator having a simple structure capable of easily achieving level adjustment of a shelf. A refrigerator has a safety device capable of preventing a shelf from unintentionally moving from an upper position to a lower position.

A refrigerator may include a cabinet defined with a storage chamber therein, and a shelf assembly mounted in the storage chamber, the shelf assembly being provided with a vertically movable shelf, wherein the shelf assembly includes a guide member mounted in the storage chamber, and provided with guide slots inclinedly formed at side walls of the guide member, the shelf being supported by the guide member, to be vertically movable, and guide protrusions provided at opposite lateral ends of the shelf, to protrude laterally, and supported by the guide slots in a state of being slidably engaged in the guide slots, wherein the guide slots have bent upper ends forming upper seats to support the guide protrusions, respectively, and each of the upper seats is formed such that a straight vertical line extending downwards from a center of the upper seat passes through a center of a lower seat formed at a corresponding one of the guide slots.

The guide slots may include a pair of first guide slots each formed at an inner surface of a rear portion in a corresponding one of the side walls of the guide member while taking the form of a groove having a predetermined depth, and a pair of second guide slots each formed at a front portion in the corresponding side wall of the guide member while taking the form of a through hole extending through the side wall.

The guide protrusions may include a pair of first guide protrusions to be guided by the first guide slots while being engaged in the first guide slots, respectively, and a pair of second guide protrusions to be guided by the second guide slots while being engaged in the second guide slots, respectively.

Each of the second guide slots may be formed to be inclined downwards from a bent portion of the upper end thereof to the upper seat thereof.

The shelf assembly may further include a pair of lever assemblies pivotally mounted to the side walls of the guide member, respectively, to push the first guide protrusions in a rearward direction when the first guide protrusions move to the upper seats of the first guide slots, respectively.

Each of the lever assemblies may include a lever guide groove formed at a corresponding one of the side walls of the guide member while having a concave shape, a pivotal pin protruding from the lever guide groove, a lever member pivotally mounted to the pivotal pin in the lever guide groove, and an elastic member disposed between one side surface of the lever guide groove and the lever member, to push the lever member in a rearward direction.

The shelf assembly may further include a pair of button assemblies respectively provided at opposite sides of a front portion of the shelf, to retract locking protrusions thereof from a state of extending outwards from respective lateral sides of the shelf when the button assemblies operate, and locking grooves respectively formed at the side walls of the guide member, to selectively receive the locking protrusions.

Each of the button assemblies may include a button mounting groove provided at a corresponding one of the opposite sides of the front portion of the shelf, a slider slidably mounted in the button mounting groove and formed, at an outer end thereof, with a corresponding one of the locking protrusions, a button to laterally move the slider when pressed by a user, and an elastic member disposed between the slider and an inner side surface of the button mounting groove, to push the slider outwards.

Each of the button assemblies may further include a cover member covering the button mounting groove while being provided with a guide groove to guide movement of the button.

The button may include an inclined surface provided at a lower portion of one side of the button. The slider may include a receiving groove formed to receive a portion of the button when the button is pressed, and an inclined surface provided at one side of the receiving groove, to slidably contact the inclined surface of the button.

Each of the lever assemblies may be mounted at a position adjacent to a corresponding one of the first guide slots. Each of the second guide slots may be formed such that a bent portion of the second guide slot disposed adjacent to the upper seat of the second guide slot has a level higher than a lower end of the upper seat.

The guide member may include the side walls including a pair of side walls formed with the guide slots, to guide vertical movement of the shelf while supporting the shelf, and a rear wall connecting rear ends of the pair of side walls.

Alternatively, the guide member may include the side walls including a pair of side walls respectively mounted to inner side walls of the storage chamber by fasteners and formed with the guide grooves, to guide vertical movement of the shelf while supporting the shelf.

The shelf may include a peripheral portion to be vertically movable while being guided by the guide member, and a shelf portion mounted to the peripheral portion inside the peripheral portion and made of a transparent material.

Each of the guide protrusions may include a roller rotatably mounted to the guide protrusion.

Each of the second guide slots may be provided, at an outer portion thereof, with a step to increase a width of the second guide slot. The roller, which is engaged in the second guide slot, may have a stepped structure, to be supported by the step while contacting the step after passing through the second guide slot.

The roller may have a greater outer diameter than an inner width of the second guide slot while being smaller than a width of the step.

In accordance with the aspect of the present disclosure, there is an effect of easily manufacturing the refrigerator because the structure for adjusting the level of the shelf is simple.

In addition, there is an effect of allowing the user to conveniently use the refrigerator because the operating mechanism for level adjustment of the shelf is simple.

Furthermore, there is little or no formation of a dead space for allowing movement of the shelf because positions of the shelf in forward and rearward directions in raised and lowered states of the shelf are the same.

In addition, it may be possible to prevent the shelf from unintentionally falling during use thereof under the condition that the shelf is positioned at a raised position.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a storage chamber therein;

a movable shelf provided within the storage chamber and having at least one pair of guide protrusions on an edge portion of the shelf, the at least one pair of guide protrusions having a round surface;

a pair of guides provided in side walls of the storage chamber, the pair of guides including:

at least one pair of guide slots that extends upwards and within which the at least one pair of the guide protrusions slides, each of the at least one pair of guide slots having an upper seat recessed rearwards from an upper end thereof to allow a corresponding one of the at least one pair of guide protrusions to be seated in the upper seat;

a pair of lever guide grooves, each of the pair of lever guide grooves provided adjacent to a corresponding one of the at least one pair of guide slots and including a pivotal pin;

a lever provided within each of the pair of lever guide grooves and having a pivotal pin hole that pivots the lever about the pivotal pin and a push portion having a recessed surface that contacts with and contours to the round surface of the guide protrusion when the guide protrusion is seated in the upper seats; and an elastic member provided within the lever guide groove to push the lever, wherein the lever is rotated by contact with the guide protrusion when the shelf is moved upwards, and the elastic member pushes the lever as the lever pushes the guide protrusion to be moved into the upper seat when the guide protrusion is moved to the upper end of the guide slot.

2. The refrigerator according to claim 1, wherein the at least one pair of guide slots include:

a pair of first guide slots, each formed at an inner surface of a rear portion in a corresponding one of the side walls of the guide member, the pair of first guide slots being a pair of grooves having a predetermined depth; and a pair of second guide slots, each formed at a front portion in the corresponding side wall of the guide member, and the pair of second guide slots being a pair of through holes extending through the side wall.

3. The refrigerator according to claim 2, wherein the at least one pair of guide protrusions include:

a pair of first guide protrusions to be guided by the pair of first guide slots and configured to engage in the pair of first guide slots; and a pair of second guide protrusions to be guided by the pair of second guide slots, and configured to engage in the pair of second guide slots.

4. The refrigerator according to claim 3, wherein each of the pair of second guide slots is formed to be inclined downwards from a bent portion of the upper end thereof to the upper seat thereof.

5. The refrigerator according to claim 2, wherein each lever is mounted at a position adjacent to a corresponding one of the pair of first guide slots; and each of the pair of second guide slots is formed such that a bent portion of the second guide slot provided adjacent to the upper seat of the second guide slot has a level higher than a lower end of the upper seat.

6. The refrigerator according to claim 2, wherein each of the at least one pair of guide protrusions includes a roller rotatably mounted to the guide protrusion.

7. The refrigerator according to claim 6, wherein each of the pair of second guide slots is provided with a step to increase a width of the second guide slot; and the roller engageable in the second guide slot and having a stepped structure to be supported by the step while contacting the step after passing through the second guide slot.

8. The refrigerator according to claim 7, wherein the roller has a greater outer diameter than an inner width of the second guide slot and being smaller than a width of the step.

9. The refrigerator according to claim 1, wherein the side walls include a pair of side walls formed with the at least one pair of guide slots to guide vertical movement of the shelf, and wherein a rear wall connects rear ends of the pair of side walls.

10. The refrigerator according to claim 1, wherein the side walls include a pair of side walls mounted to inner side walls of the storage chamber by fasteners and formed with the guide grooves to guide vertical movement of the shelf.

11. The refrigerator according to claim 1, wherein the shelf includes:

a peripheral portion vertically movable and configured to be guided by the guide; and a shelf portion mounted to the peripheral portion inside of the peripheral portion and made of a transparent material.

12. The refrigerator according to claim 1, wherein each of the pair of upper seats is formed such that a straight vertical line extending downwards from a center of the upper seat passes through a center of a lower seat formed at a corresponding one of the guide slots.

13. The refrigerator according to claim 1, wherein the pivotal pin is provided at a bottom portion of each of the pair of lever guide grooves.

14. The refrigerator according to claim 1, wherein each of the at least one pair of guide slots extends in a substantially vertical direction and the upper seat thereof extends in a substantially horizontal direction.

15. The refrigerator according to claim 1, wherein the shelf assembly further includes:

a pair of button assemblies provided at opposite sides of a front portion of the shelf to retract locking protrusions thereof from extending outwards from respective lateral sides of the shelf when the pair of button assemblies operate; and locking grooves formed at the side walls of the guide to selectively receive the locking protrusions.

16. The refrigerator according to claim 15, wherein each of the pair of button assemblies comprises:

a button mounting groove provided at a corresponding one of the opposite sides of the front portion of the shelf;

a slider slidably mounted in the button mounting groove and formed, at an outer side end thereof, with a corresponding one of the locking protrusions;

a button mounted on the slider and that protrudes upwards from an upper surface of the shelf to laterally move the slider when pressed downwards by a user; and an elastic member provided between the slider and an inner side surface of the button mounting groove to push the slider outwards.

17. The refrigerator according to claim 16, wherein each of the pair of button assemblies further includes a cover that covers the button mounting groove while being provided with a guide groove to guide movement of the button.

18. The refrigerator according to claim 16, wherein the button includes an inclined surface provided at a lower portion of one side of the button; and the slider includes a receiving groove formed to receive a portion of the button when the button is pressed, and an inclined surface provided at one side of the receiving groove to slidably contact the inclined surface of the button.

19. A refrigerator comprising:

a cabinet having a storage chamber therein;

a movable shelf provided within the storage chamber and having at least one pair of guide protrusions on an edge portion of the shelf;

a pair of guides provided in side walls of the storage chamber, the pair of guides including:

at least one pair of guide slots that extends upwards in a substantially vertical direction and within which the at least one pair of the guide protrusions slides, each of the at least one pair of guide slots having an upper seat recessed rearwards from an upper end thereof to allow a corresponding one of the at least one pair of guide protrusions to be seated in the upper seat;

a pair of lever guide grooves, each of the pair of lever guide grooves provided adjacent to a corresponding one of the at least one pair of guide slots and including a pivotal pin;

a lever provided within each of the pair of lever guide grooves and having a pivotal pin hole provided at a first end that pivots the lever about the pivotal pin and a push portion that contacts with and contours to the guide protrusion when the guide protrusion is seated in the upper seats; and an elastic member provided within the lever guide groove to push the lever at a second end opposite the first end of the lever, wherein the lever is rotated by contact with the guide protrusion when the shelf is moved upwards, and the elastic member pushes the second end of the lever so that the lever pushes the guide protrusion to be moved into the upper seat when the guide protrusion is moved to the upper end of the guide slot.

20. The refrigerator according to claim 19, wherein an inclination angle of each of the at least one pair of guide slots is no more than 20° with respect to a vertical line perpendicular to a bottom surface of the refrigerator.

* * * * *